US009108647B2

(12) United States Patent
Taguchi et al.

(10) Patent No.: US 9,108,647 B2
(45) Date of Patent: Aug. 18, 2015

(54) BODYSHELL STRUCTURE OF RAILCAR

(75) Inventors: Makoto Taguchi, Akashi (JP); Atsushi Sano, Kakogawa (JP); Toshiyuki Yamada, Kobe (JP); Hideki Kumamoto, Akashi (JP); Seiichiro Yagi, Akashi (JP); Masayuki Tomizawa, Akashi (JP)

(73) Assignee: KAWASAKI JUKOGYO KABUSHIKI KAISHA, Kobe (JP)

( * ) Notice: Subject to any disclaimer, the term of this patent is extended or adjusted under 35 U.S.C. 154(b) by 192 days.

(21) Appl. No.: 13/809,994

(22) PCT Filed: Jul. 12, 2011

(86) PCT No.: PCT/JP2011/003984
§ 371 (c)(1),
(2), (4) Date: Feb. 6, 2013

(87) PCT Pub. No.: WO2012/008147
PCT Pub. Date: Jan. 19, 2012

(65) Prior Publication Data

US 2013/0152820 A1 Jun. 20, 2013

(30) Foreign Application Priority Data

Jul. 12, 2010 (JP) ..... 2010-157608

(51) Int. Cl.
*B61D 17/08* (2006.01)
*B61D 17/04* (2006.01)

(52) U.S. Cl.
CPC ..... *B61D 17/08* (2013.01); *B61D 17/041* (2013.01)

(58) Field of Classification Search
CPC ..... B61D 17/08; B61D 25/00; B61D 1/04; B60J 1/08; B60J 1/10
USPC ..... 105/345, 329.1, 344, 397, 401; 296/64
See application file for complete search history.

(56) References Cited

U.S. PATENT DOCUMENTS

| | | | | |
|---|---|---|---|---|
| 1,958,234 | A * | 5/1934 | Cleveland | 296/178 |
| 2,625,890 | A * | 1/1953 | Dean | 105/401 |
| 2,646,008 | A * | 7/1953 | Eksergian et al. | 105/401 |
| 4,995,321 | A * | 2/1991 | Ohmura et al. | 105/396 |
| 5,595,123 | A * | 1/1997 | Tao et al. | 105/396 |
| 7,789,020 | B2 * | 9/2010 | Li | 104/130.01 |
| 2009/0255437 | A1 | 10/2009 | Hachet et al. | |

FOREIGN PATENT DOCUMENTS

| | | |
|---|---|---|
| JP | B1-40-6294 | 3/1965 |
| JP | Y1-40-33606 | 11/1965 |
| JP | A-2-95971 | 4/1990 |
| JP | A-10-194117 | 7/1998 |
| JP | A-10-315961 | 12/1998 |
| JP | A-2006-151392 | 6/2006 |
| JP | A-2009-214876 | 9/2009 |

OTHER PUBLICATIONS

Oct. 11, 2011 Extended International Search Report issued in International Application No. PCT/JP2011/003984 (with translation).

* cited by examiner

*Primary Examiner* — Mark Le
(74) *Attorney, Agent, or Firm* — Oliff PLC

(57) ABSTRACT

A bodyshell structure of a railcar, includes a plurality of side window opening portions formed on a side bodyshell along a railcar longitudinal direction, and the side window opening portions include a plurality of large window opening portions arranged on a railcar-longitudinal-direction center portion of the side bodyshell and a plurality of small window opening portions arranged on both railcar-longitudinal-direction sides of the large window opening portions and each having a smaller opening area than the large window opening portion.

4 Claims, 7 Drawing Sheets

BODYSHELL STRUCTURE OF RAILCAR

TECHNICAL FIELD

The present invention relates to a bodyshell structure of a railcar, and particularly to a bodyshell structure configured to improve ride quality and be reduced in mass.

BACKGROUND ART

In recent years, a reduction in mass of railcars has been demanded with an increase in speed of the railcars, and railcars that are improved in comfort of passengers, such as ride quality, have been strongly demanded. In response to these, known is a railcar bodyshell that is improved in the ride quality by reducing the sizes of side windows to increase bending stiffness of the bodyshell.

Known as one of the structures of side bodyshells of railcars is a double skin structure using an aluminum alloy hollow extruded section constituted by two face plates and ribs each coupling these face plates to each other. The reduction in mass and the improvement in ride quality of the railcar having the above structure have also been demanded. In response to these, PTL 1 proposes a railcar bodyshell configured such that only the thickness of a face plate of a hollow section constituting a pier panel that is a portion between windows of the side bodyshell is uniformly increased in a railcar longitudinal direction as compared to the thickness of a face plate of the other hollow section constituting the side bodyshell. PTL 1 describes that the railcar bodyshell that is high in bending stiffness and light in mass can be provided by the above configuration.

CITATION LIST

Patent Literature

PTL 1: Japanese Laid-Open Patent Application Publication No. 10-194117

SUMMARY OF INVENTION

Technical Problem

However, if the sizes of the side windows are reduced, passengers' visions from the inside of the railcar are limited, so that open feeling decreases. In addition, in the railcar bodyshell described in PTL 1, since the thickness of the face plate of the hollow section constituting the pier panel is increased in the railcar longitudinal direction, the bending stiffness can be increased, but the problem is that the mass of the railcar increases.

Here, an object of the present invention is to provide a bodyshell structure of railcar, the bodyshell structure being increased in bending stiffness, improved in ride quality, and reduced in mass.

Solution to Problem

The present invention is a bodyshell structure of a railcar, the bodyshell structure including a side bodyshell including a plurality of side window opening portions formed along a railcar longitudinal direction, wherein the side window opening portions include a plurality of large window opening portions arranged on a railcar-longitudinal-direction center portion and a plurality of small window opening portions arranged on both railcar-longitudinal-direction sides of the large window opening portions and each having a smaller opening area than the large window opening portion.

According to this, the plurality of side window opening portions are formed by combining the plurality of large window opening portions arranged on the railcar-longitudinal-direction center portion and the plurality of small window opening portions arranged on both railcar-longitudinal-direction sides of the large window opening portions and each having a smaller opening area than the large window opening portion. Therefore, as compared to a case where the side window opening portions are formed only by the large window opening portions, the number of pier panel portions each between the side window opening portions can be increased, and the areas of the pier panel portions can be increased. On this account, the bending stiffness of the bodyshell can be increased, and the ride quality can be improved. In addition, since the plurality of large window opening portions each having a large opening area are arranged on the railcar-longitudinal-direction center portion, the passengers' visions from the inside of the railcar can be secured.

BRIEF DESCRIPTION OF DRAWINGS

FIG. 1A is a side view. FIG. 1B is a perspective view showing a part of the carbody when viewed from the inside of a railcar. FIG. 1C is an enlarged view of a portion A shown in FIG. 1B.

FIG. 3A is a side view. FIG. 3B is a perspective view showing a part of the carbody when viewed from the inside of the railcar.

FIG. 4A shows an outside window opening portion of the embodiment of the present invention. FIG. 4B shows a conventional outside window opening portion.

FIG. 5A shows the optimization result of the bodyshell structure according to the embodiment of the present invention. FIG. 5B shows the optimization result of the bodyshell structure according to the modification example of the embodiment of the present invention.

FIG. 7A shows a relation between a large window opening portion and the seat. FIG. 7B shows a relation between a small window opening portion and the seat.

DESCRIPTION OF EMBODIMENTS

Hereinafter, a bodyshell structure of a railcar according to an embodiment of the present invention will be explained in reference to the drawings.

Figure 1A:
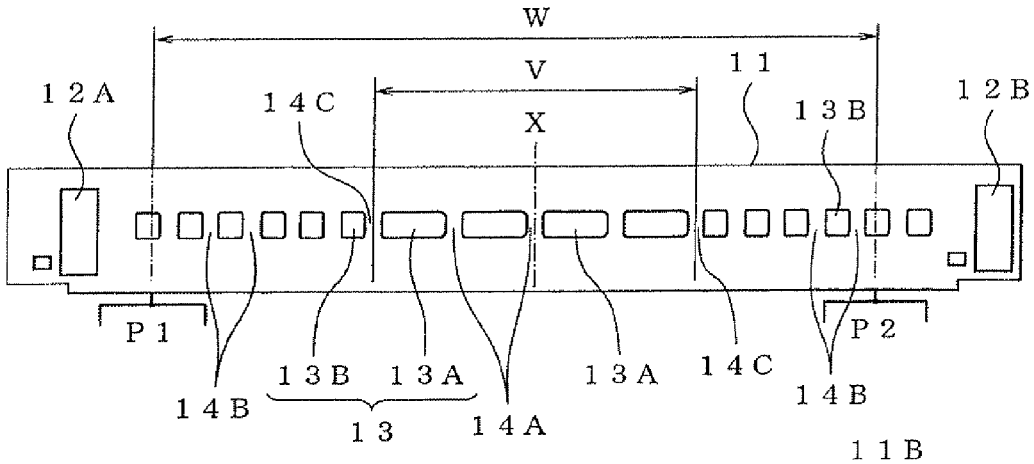
FIGS. 1A to 1C Each of FIGS. 1A to 1C shows the schematic configuration of a carbody according to an embodiment of the present invention.
Figure 1B:
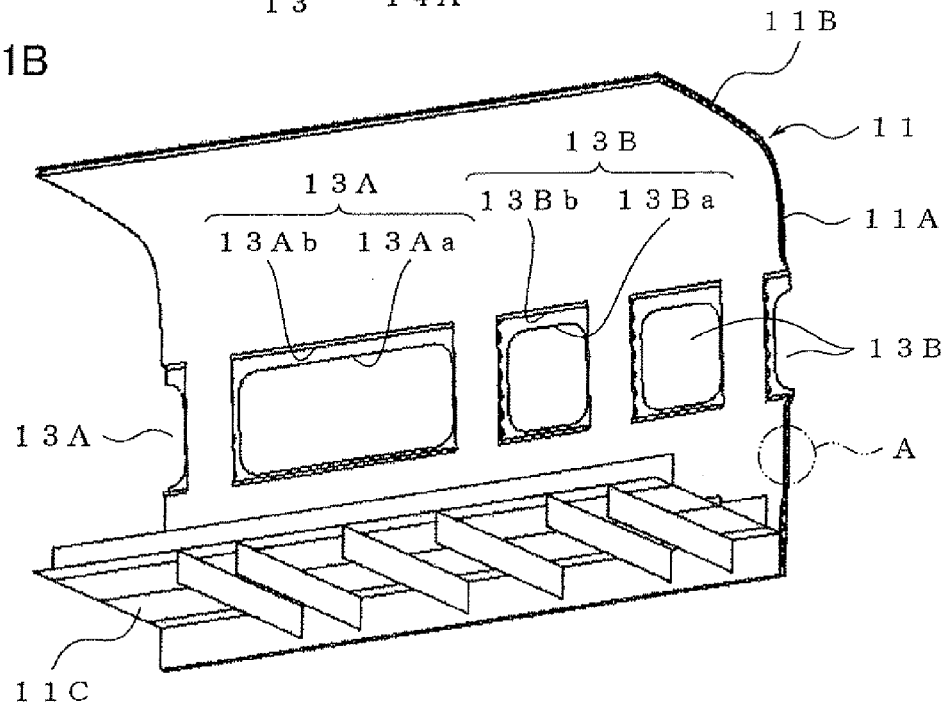
Figure 1C:
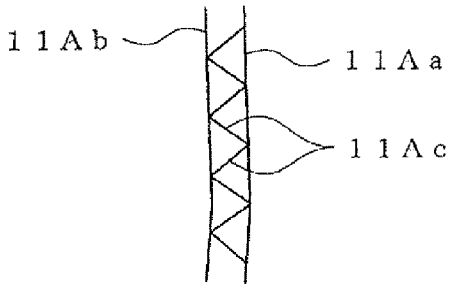

Each of FIGS. 1A to 1C shows the schematic configuration of a carbody included in the present embodiment. FIG. 1A is a side view. FIG. 1B is a perspective view showing a part of the carbody when viewed from the inside of the railcar. In the drawings, reference signs P1 and P2 denote fulcrums supporting a carbody 11 and respectively correspond to portions of truck bolsters of front and rear truck frames.

As shown in FIGS. 1A and 1B, the carbody 11 of the railcar (passenger car) includes a side bodyshell 11A. A roof bodyshell 11B is coupled to an upper portion of the side bodyshell 11A, and an underframe 11C is coupled to a lower portion thereof. The side bodyshell 11A includes entrance opening portions 12A and 12B and a plurality of side window opening portions 13. As shown in FIG. 1C, the side bodyshell 11A has an aluminum alloy double skin structure which includes an outside plate portion 11Aa, an inside plate portion 11Ab, and a web portion (joint portion) 11Ac and in which the outside plate portion 11Aa and the inside plate portion 11Ab are coupled to each other by the web portion 11Ac.

The entrance opening portions 12A and 12B are respectively formed at front and rear side portions of the side bodyshell 11A. A plurality of side window opening portions 13 are formed between the entrance opening portions 12A and 12B at regular intervals along a railcar longitudinal direction. The side window opening portions 13 include four large window opening portions 13A having a substantially rectangular shape that is long in the railcar longitudinal direction, six small window opening portions 13B on the front side, and six small window opening portions 13B on the rear side, the small window opening portions 13B each having a shorter length than the large window opening portion 13A in the railcar longitudinal direction. A plurality of large window opening portions 13A are arranged at a railcar-longitudinal-direction center portion of the side bodyshell 11A, the small window opening portions 13B are formed between the large window opening portion 13A and the entrance opening portion 12A, and the small window opening portions 13B are also formed between the large window opening portion 13A and the entrance opening portion 12B. The load of the carbody is supported by the portions P1 and P2, and shear force larger than shear force acting on the center portion of the side bodyshell 11A acts on the portions P1 and P2. In order that the side bodyshell 11A withstands the shear force, the small window opening portions 13B are arranged on both sides of the large window opening portions 13A, that is, in the vicinities of the portions P1 and P2. Thus, the number of pier panel portions 14B is increased. Since the shear force is small at the center portion, providing the large window opening portions 13A at the center portion does not cause any problem.

Next, details of the side window opening portion 13 (the large window opening portion 13A and the small window opening portion 13B) will be explained.

As shown in FIG. 1B, the large window opening portions 13A include outside window openings 13Aa formed on the outside plate portion 11Aa and inside window openings 13Ab formed on the inside plate portion 11Ab. Each of the outside window opening 13Aa and the inside window opening 13Ab has a substantially rectangular shape that is long in the railcar longitudinal direction. Here, the inside window opening 13Ab is formed by cutting off the inside plate portion 11Ab and the web portion 11Ac. An opening area of the inside window opening 13Ab is larger than that of the outside window opening 13Aa. This is because a window unit including window glass and a sash is attached from the inside of the railcar.

Although the small window opening portion 13B is different in size from the large window opening portion 13A, as with the large window opening portion 13A, the small window opening portions 13B include outside window openings 13Ba formed on the outside plate portion 11Aa and inside window openings 13Bb formed on the inside plate portion 11Ab, and the inside window opening 13Bb is formed by cutting off the inside plate portion 11Ab and the web portion 11Ac.

A length of a pier panel portion 14A between the large window opening portions 13A in the railcar longitudinal direction, a length of a pier panel portion 14B between the small window opening portions 13B in the railcar longitudinal direction, and a length of a pier panel portion 14C between the large window opening portion 13A and the small window opening portion 13B in the railcar longitudinal direction are equal to one another.

A height of the large window opening portion 13A (the outside window opening 13Aa) in a railcar vertical direction and a height of the small window opening portion 13B (the outside window opening 13Ba) in the railcar vertical direction are equal to each other. A length of the large window opening portion 13A in the railcar longitudinal direction is equal to a sum of lengths of two small window opening portions 13B in the railcar longitudinal direction and a length of the pier panel portion 14B between the two small window opening portions 13B in the railcar longitudinal direction.

Figure 2:
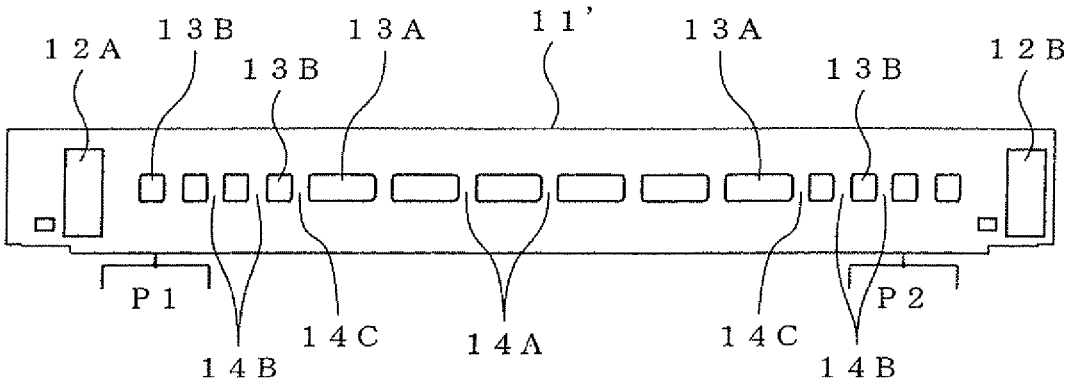
FIG. 2 is a side view showing the schematic configuration of the carbody according to a modification example of the embodiment of the present invention.

In the carbody 11 shown in FIGS. 1A to 1C, the side window opening portions 13 include four large window opening portions 13A, six small window opening portions 13B on the front side, and six small window opening portions 13B on the rear side. However, as in a carbody 11' shown in FIG. 2, side window opening portions 13' may include six large window opening portions 13A, four small window opening portions 13B on the front side, and four small window opening portions 13B on the rear side.

Figure 3A:
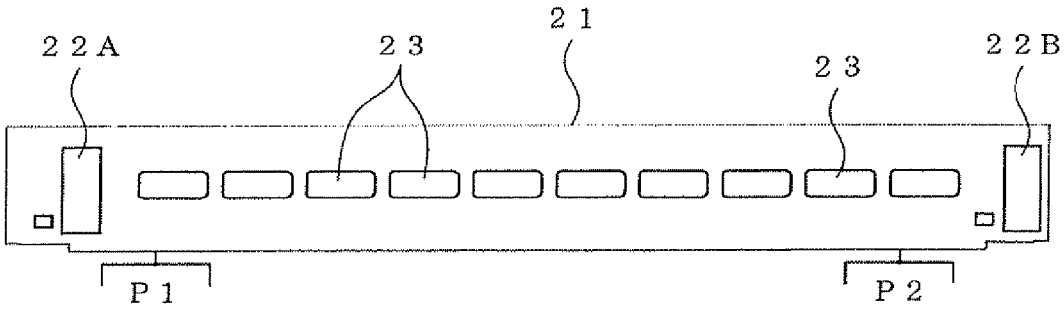
FIGS. 3A and 3B Each of FIGS. 3A and 3B schematically shows a conventional carbody.
Figure 3B:
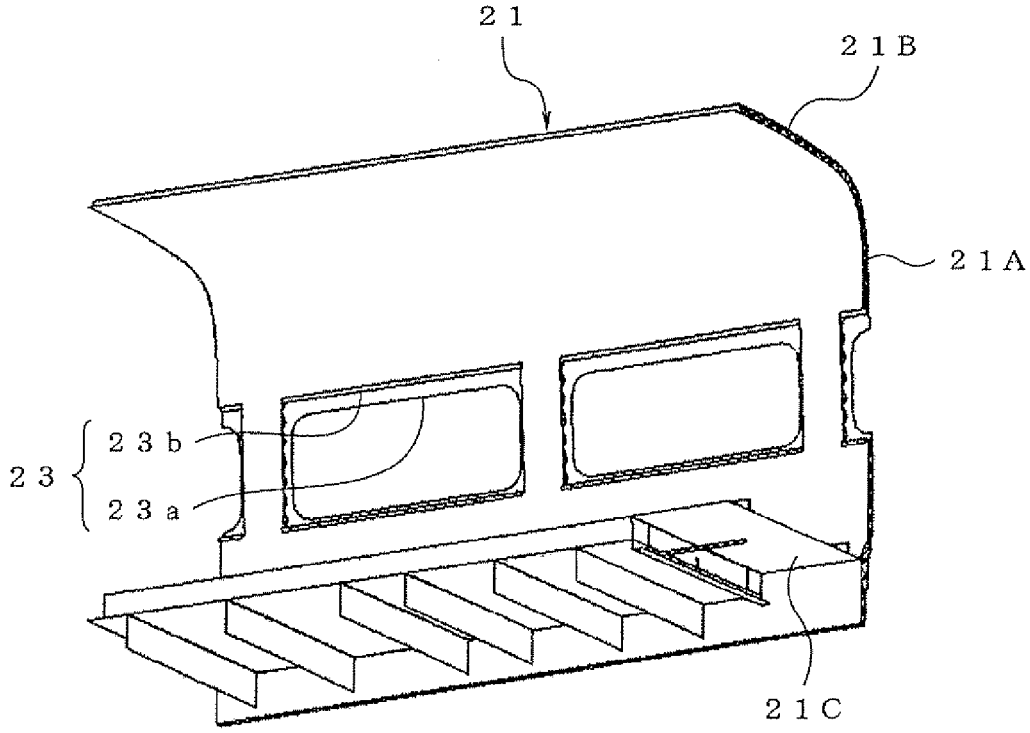

Next, differences between the side window opening portion 13 of the present embodiment and a conventional side window opening portion 23 will be explained. Each of FIGS. 3A and 3B schematically shows a conventional carbody. FIG. 3A is a side view. FIG. 3B is a perspective view showing a part of the carbody when viewed from the inside of the railcar.

A conventional carbody 21 includes entrance opening portions 22A and 22B respectively formed at front and rear side portions of a side bodyshell 21A. The side window opening portions 23 are formed between the entrance opening portions 22A and 22B at regular intervals along the railcar longitudinal direction. Each of the side window opening portions 23 is a large window opening portion having a substantially rectangular shape that is long in the railcar longitudinal direction. Ten side window opening portions 23 are provided.

This conventional case is the same as the above embodiment in that: the side bodyshell 21A has an aluminum alloy double skin structure including an outside plate portion, an inside plate portion, and a web portion (joint portion); and the side window opening portions 23 include outside window openings 23*a* formed on the outside plate portion of the side bodyshell 21A and inside window openings 23*b* formed on the inside plate portion of the side bodyshell 21A. Each of the outside window opening 23*a* and the inside window opening 23*b* has a rectangular shape that is long in the railcar longitudinal direction. A reference sign 21B denotes a roof bodyshell coupled to an upper portion of the side bodyshell 21A, and a reference sign 21C denotes an underframe connected to a lower portion of the side bodyshell 21A.

Figure 4A:
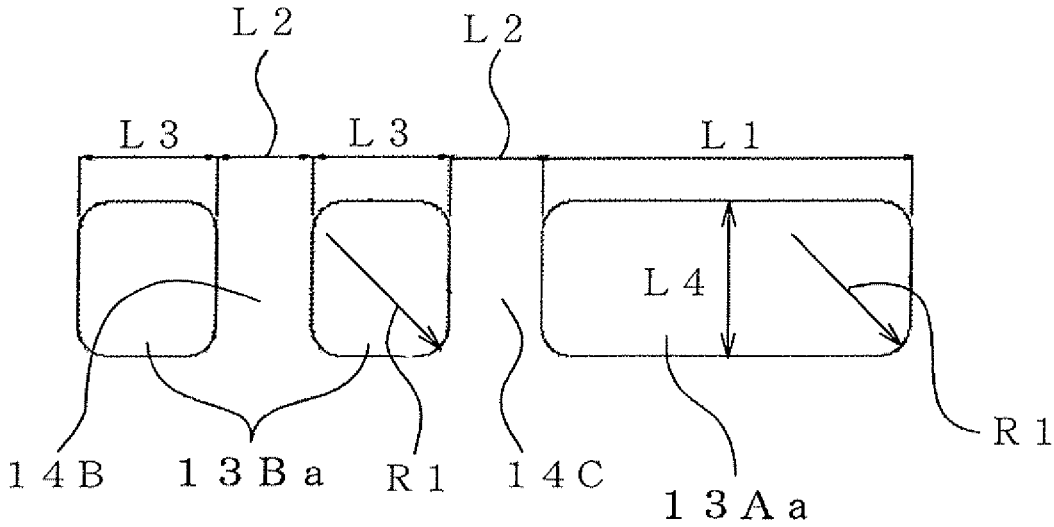
FIGS. 4A and 4B Each of FIGS. 4A and 4B is a partially enlarged view of a side window opening portion.
Figure 4B:
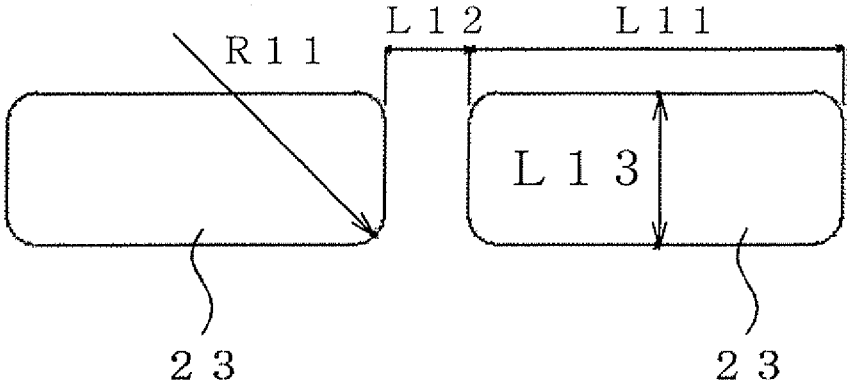

Each of FIGS. 4A and 4B is a partially enlarged view of the side window opening portion. FIG. 4A shows an outside window opening portion 13*a* of the embodiment of the present invention. FIG. 4B shows the conventional outside window opening portion 23*a*. As shown in FIG. 4A, in the present embodiment, a length L1 of the outside window opening 13Aa of the large window opening portion 13A in the railcar longitudinal direction is 1,560 mm, a length L2 of each of the pier panel portions 14A, 14B, and 14C in the railcar longitudinal direction (an interval L2 between the outside window openings 13Aa and 13Ba adjacent to each other) is 400 mm, and a length L3 of the outside window opening 13Ba of the small window opening portion 13B in the railcar longitudinal direction is 580 mm. Therefore, the length L1 of the outside window opening 13Aa of the large window opening portion 13A in the railcar longitudinal direction is equal to a sum of the length L2 of the pier panel portion 14B in the railcar longitudinal direction and the lengths L3 of the outside window openings 13Ba of two small window opening portions 13B in the railcar longitudinal direction (L1=L2+2×L3). In addition, a length L4 of the outside window opening 13Aa in the railcar vertical direction is 650 mm, and a curvature radius R1 of a curved portion of each corner of the outside window opening 13Aa is 125 mm.

For example, the length of the large window opening portion 13A in the carbody longitudinal direction is set to 1,560 mm, that is, larger than the small window opening portion 13B having the length of 580 mm. With this, the wide vision from the inside of the railcar can be secured, the open feeling can be offered to the passengers, and the comfort can be improved. In addition, since the number of pier panel portions can be made larger than the number of conventional side window opening portions 23, and the areas of the pier panel portions can be made larger than those of the conventional side window opening portions 23, the bending stiffness of the bodyshell can be increased, and the ride quality can be improved.

Figure 7A:
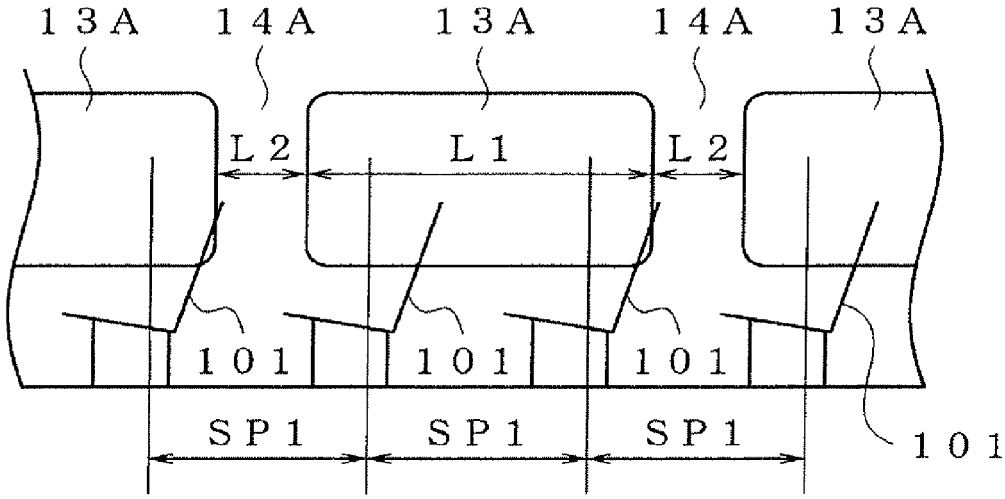
FIGS. 7A and 7B Each of FIGS. 7A and 7B shows a relation between a window opening portion and a seat in the embodiment of the present invention.
Figure 7B:
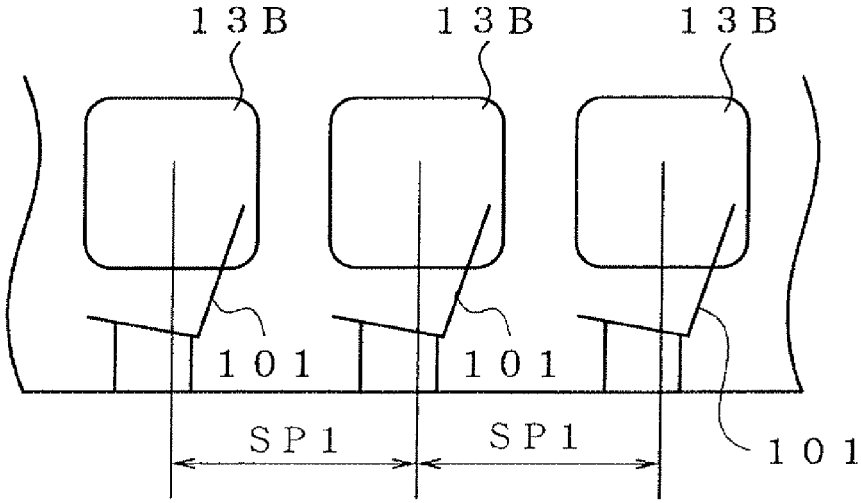

As shown in FIGS. 7A and 7B, the seats on which the passengers are seated are arranged in a transverse seat arrangement (so-called cross seat arrangement) in which each seat is provided orthogonal to the railcar longitudinal direction of the carbody 11. As shown in FIG. 7A, the length L1 of the large window opening portion 13A in the railcar longitudinal direction needs to be larger than a pitch SP1 between the seats adjacent to each other in the railcar longitudinal direction and smaller than twice the pitch SP1, and is preferably about 1.5 times the pitch SP1. For example, the length L1 of the large window opening portion 13A in the railcar longitudinal direction is a length obtained by subtracting the length L2 of the pier panel portion 14A in the railcar longitudinal direction from twice the seat pitch SP1 (L1=2×SP1−L2). As shown in FIG. 7B, one small window opening portion 13B is arranged for one transverse seat 101, and a pitch between the small window opening portions 13B is equal to the seat pitch SP1.

By adjusting the pitch between the seats and the length of the pier panel portion, one large window opening portion 13A is arranged for two seats, and one small window opening portion 13B is arranged for one seat. In a case where the railcar runs in any direction along the railcar longitudinal direction, the visions from the window opening portions 13A and 13B can be secured for the passengers on the seats.

As shown in FIG. 4B, a length L11 of the conventional side window opening portion 23 in the railcar longitudinal direction is 1,600 mm, an interval L12 between the adjacent outside window openings is 360 mm, a length L13 of the conventional side window opening portion 23 in the railcar vertical direction is 650 mm, and a curvature radius R11 of a curved portion of each corner of the outside window opening is 125 mm.

As above, in the present embodiment, the number of pier panel portions is made larger than that of the conventional structure, and the total area of the pier panel portions is made larger than that of the conventional structure. A bending load (shear force) acts on the carbody 11 by using the portions P1 and P2 of the truck bolsters of the truck frames as the fulcrums. However, by increasing the pier panel portions as above, the bodyshell structure whose bending stiffness is increased can be realized.

Next, an optimization analysis was carried out, which minimizes the mass of the bodyshell on condition that a design variable is the thickness of an extruded section of the aluminum alloy double skin structure, a limiting condition is the natural frequency of the carbody, and an objective function is the mass of the bodyshell. In order to secure satisfactory ride quality of the railcar, it is preferable that the natural frequency of the carbody be set to be higher than the natural frequency of a spring system of the truck by 1 Hz or more. Here, in the present embodiment, when the natural frequency of the spring system of the truck is N Hz, the natural frequency of the carbody that is the limiting condition is set to N+1.2 Hz. The natural frequency of the carbody having the conventional structure shown in FIGS. 3A and 3B is N+0.2 Hz.

Figure 5A:
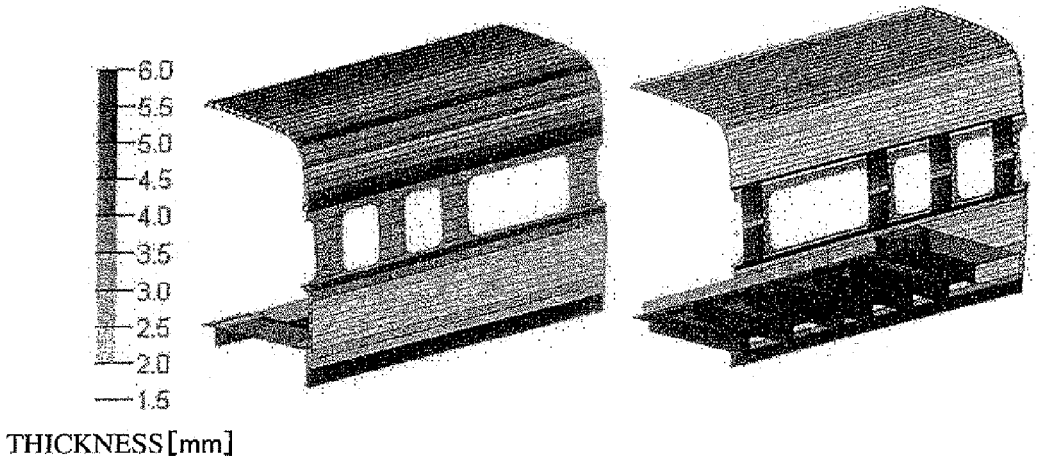
FIGS. 5A to 5B Each of FIGS. 5A to 5B shows an optimization result of a thickness distribution.
Figure 5B:
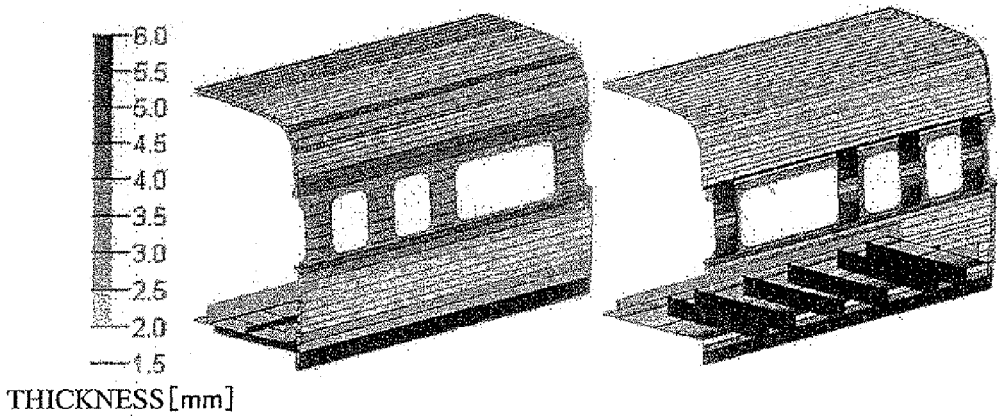
Figure 5C:
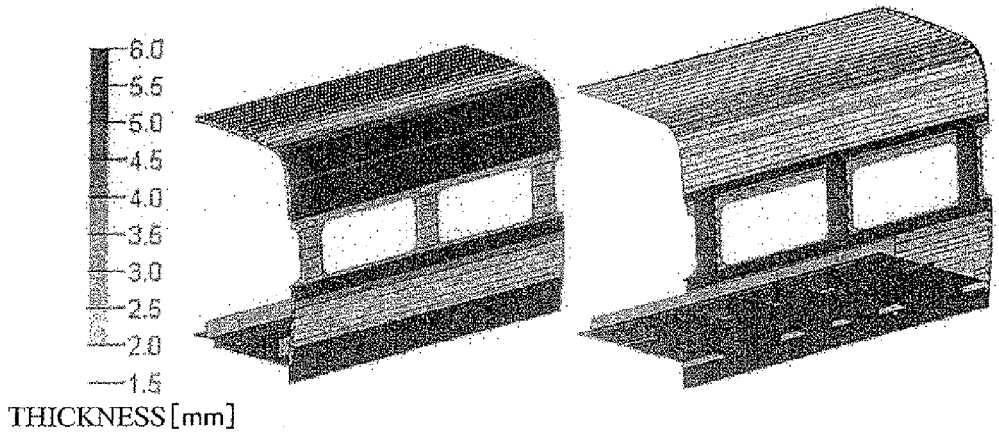
FIG. 5C shows the optimization result of a conventional bodyshell structure.

Each of FIGS. 5A to 5C is a diagram showing an optimization result of a thickness distribution. FIG. 5A shows the optimization result of the bodyshell structure according to the embodiment of the present invention. FIG. 5B shows the optimization result of the bodyshell structure according to a modification example of the embodiment of the present invention. FIG. 5C shows the optimization result of a conventional bodyshell structure.

According to the above results, in order to increase the natural frequency of the carbody of the conventional bodyshell structure up to N+1.2 Hz, the thickness distribution becomes the thickness distribution shown in FIG. 5C, and the mass of the bodyshell increases by 1.86 tons. In the case of the bodyshell structure of the present embodiment, the thickness distribution becomes the thickness distribution shown in FIG. 5A or 5B, and the mass of the bodyshell structure increases only by 0.47 ton or 0.81 ton. The optimization results shown in FIGS. 5A to 5C are results in a case where the natural frequency N of the spring system of the truck was set to 8.5 Hz. However, it has been confirmed that the same results as above can be obtained even if the natural frequency N of the spring system of the truck varies.

As above, according to the bodyshell structure of the railcar of the present embodiment, the ride quality is improved, and the comfort is increased. In addition, the reduction in mass of the railcar can be realized.

Based on the sizes of the side window opening portions shown in FIG. 4A, calculated is a length V of a range where the large window opening portions 13A are arranged about a railcar-longitudinal-direction center position X of the carbody 11 between the truck bolsters of the truck frames supporting the carbody 11 (between the portions P1 and P2) (see FIG. 1A). According to this calculation, regarding the carbody 11 shown in FIGS. 1A to 1C, in a case where a railcar-longitudinal-direction length between the truck bolsters is W, the large window opening portions 13A are arranged in the range having the length V corresponding to about 4/9 of the length W. Regarding the carbody 11' shown in FIG. 2, the large window opening portions 13A are arranged in a range having a length corresponding to about 5/9 of the length W.

Therefore, in a case where the large window opening portions 13A are arranged in the range having the railcar-longitudinal-direction length V corresponding to 4/9 to 5/9 of the railcar-longitudinal-direction length W between the truck bolsters about the railcar-longitudinal-direction center portion X between the truck bolsters (P1 and P2) of the truck frames supporting the carbody 11 (see FIG. 1A), it is expected that the bending stiffness is increased, the ride quality is improved, and the reduction in mass is realized. The reason why only the portion between the truck bolsters of the truck frames (between the portions P1 and P2) is considered is because this portion affects the bending stiffness of the carbody 11.

The above embodiment may be modified as below to be carried out.

(i) The side bodyshell has the aluminum alloy double skin structure, but the present invention is not limited to this. The present invention may be applied to the single skin structure including only the outside plate portion. This is because since the number of pier panel portions can be increased, and the areas of the pier panel portions can be increased as with the above-described case, the bending stiffness can be increased, and the ride quality can be improved.

Figure 6:
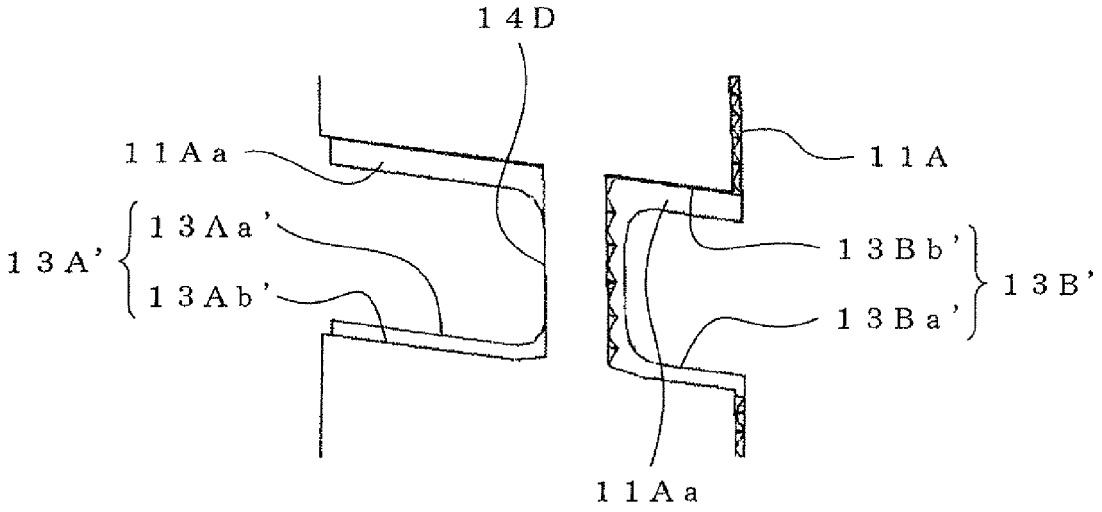
FIG. 6 is a partially enlarged view of a portion between the side window opening portions when viewed from the inside of the railcar in another modification example of the embodiment of the present invention.

(ii) As shown in FIG. 6, large window opening portions 13A' and small window opening portions 13W may be formed such that the opening area of each of outside window openings 13Aa' and 13Ba' formed on the outside plate portion is further made smaller than the opening area of each of inside window openings 13Ab' and 13Bb' formed on the inside plate portion as compared to the above-described case, and the area of the portion where only the outside plate portion 11Aa exist as the single skin structure is increased. With this, the area of a pier panel portion 14D can be made larger than that of the conventional side window opening portion. Thus, the bending stiffness can be increased, and the ride quality can be improved.

(iii) Each of the opening shape of the large window opening portion and the opening shape of the small window opening portion is not limited to the above-described substantially rectangular shape. For example, the large window opening portion may have a substantially oval shape, and the small window opening portion may have a substantially circular shape (for example, a substantially perfect circular shape or a substantially elliptical shape).

The invention claimed is:

1. A bodyshell structure of a railcar, the bodyshell structure comprising:

a side bodyshell including a plurality of side window opening portions formed along a railcar-longitudinal-direction; and a plurality of seats arranged in the railcar-longitudinal-direction, wherein:

the side window opening portions include a plurality of large window opening portions arranged on a railcar-longitudinal-direction center portion of the side bodyshell and a plurality of small window opening portions arranged on each of both railcar-longitudinal-direction sides of the large window opening portions, the plurality of small window opening portions being disposed between a plurality of fulcrums corresponding to truck bolsters of truck frames supporting a carbody, and each of the plurality of small window opening portions having a smaller opening area than the large window opening portion;

a pitch between the small window opening portions in the railcar-longitudinal-direction is equal to a pitch between the seats in the railcar-longitudinal-direction;

the small window opening portions are arranged such that one small window opening portion corresponds to one seat, and the large window opening portions are arranged such that one large window opening portion corresponds to two seats;

a first longitudinal length between each of the plurality of large window opening portions, a second longitudinal length between each of the plurality of small window opening portions, and a third longitudinal length between the plurality of large window opening portions and the plurality of small window opening portions are equivalent; and a length of the large window opening portion in the railcar-longitudinal-direction is equal to a sum of a length of a pier panel portion in the railcar-longitudinal-direction and lengths of two small window opening portions in the railcar-longitudinal-direction, the pier panel portion being a portion between the small window opening portions.

2. The bodyshell structure according to claim 1, wherein between the truck bolsters of the truck frames supporting the carbody, the large window opening portions are arranged only in a range having a length of ⅘ to ⅚ of a railcar-longitudinal-direction length between the truck bolsters about a railcar-longitudinal-direction center position between the truck bolsters.

3. The bodyshell structure according to claim 1, wherein the side bodyshell includes an outside plate portion, an inside plate portion, and a joint portion configured to join the outside plate portion and the inside plate portion.

4. A bodyshell structure of a railcar, the bodyshell structure comprising:

a side bodyshell including a plurality of side window opening portions formed along a railcar-longitudinal-direction; and a plurality of seats arranged in the railcar-longitudinal-direction, wherein:

the side window opening portions include a plurality of large window opening portions arranged on a railcar-longitudinal-direction center portion of the side bodyshell and a plurality of small window opening portions arranged on both railcar-longitudinal-direction sides of the large window opening portions and each of the plurality of small window opening portions having a smaller opening area than the large window opening portion;

a pitch between the small window opening portions in the railcar-longitudinal-direction is equal to a pitch between the seats in the railcar-longitudinal-direction;

the small window opening portions are arranged such that one small window opening portion corresponds to one seat, and the large window opening portions are arranged such that one large window opening portion corresponds to two seats;

between the truck bolsters of the truck frames supporting the carbody, the large window opening portions are arranged in a range having a length of ⅘ to ⅚ of a railcar-longitudinal-direction length between the truck bolsters about a railcar-longitudinal-direction center position between the truck bolsters; and a length of the large window opening portion in the railcar-longitudinal-direction is equal to a sum of a length of a pier panel portion in the railcar-longitudinal-direction and lengths of two small window opening portions in the railcar-longitudinal-direction, the pier panel portion being a portion between the small window opening portions.

* * * * *